United States Patent [19]

Koelling

[11] Patent Number: 4,851,802

[45] Date of Patent: Jul. 25, 1989

[54] ELECTROMAGNETIC RELAY

[75] Inventor: Dieter Koelling, Berlin, Fed. Rep. of Germany

[73] Assignee: Siemens Aktiengesellschaft, Berlin and Munich, Fed. Rep. of Germany

[21] Appl. No.: 192,300

[22] Filed: May 10, 1988

[30] Foreign Application Priority Data

May 13, 1987 [DE] Fed. Rep. of Germany ..... 3716007

[51] Int. Cl.[4] ..... H01F 7/08

[52] U.S. Cl. ..... 335/274; 335/275

[58] Field of Search ..... 335/270, 274, 275, 276, 335/279

[56] References Cited

U.S. PATENT DOCUMENTS 3,260,818 7/1966 Fisher et al. ..... 335/274 X
4,346,359 8/1982 Pirner et al. ..... 335/202

FOREIGN PATENT DOCUMENTS 1190103 4/1965 Fed. Rep. of Germany .
1514653 12/1965 Fed. Rep. of Germany ..... 335/274
2617631 11/1977 Fed. Rep. of Germany .
1333968 10/1973 United Kingdom .

*Primary Examiner*—George Harris
*Attorney, Agent, or Firm*—Hill, Van Santen, Steadman & Simpson

[57] ABSTRACT

A relay includes a coil member having an axial cavity within which is an elongated rigid armature interacting with at least one pole plate in contacting fashion. The armature is positioned in the coil member by a spring frame which is prestressed to the quiescent position. The spring frame has two cross legs approximately parallel to the armature plane and two long legs extending laterally of the armature and lying in planes perpendicular to the armature plane. A spring tongue extends from one of the cross legs and to between the long legs, the free end of the spring tongue being connected to the armature. The spring frame produces a stable holding for the armature in the coil member and provides operational adjustment from outside the relay.

16 Claims, 4 Drawing Sheets

ELECTROMAGNETIC RELAY

BACKGROUND OF THE INVENTION

1. Field of the Invention

The present invention relates generally to an electromagnetic relay and, more particularly, to a relay including a coil member carrying a winding and having an axial cavity within which extends an elongated armature, at least one pole plate projecting into the coil member for interaction with the armature, a yoke arrangement positioned essentially outside of the coil member, and a restoring spring secured to the coil member and connected to the armature to bias the armature to a quiescent position.

2. Description of the Related Art

German Patent No. AS 11 90 103 discloses a relay having a coil member with an axial cavity within which is an armature. However, the armature does not directly serve for electrical contacting. From the contrary, a contact spring is actuated by the armature and the contact spring interacts with a separate contact member. In the known relay, the coil member is composed of two shell-like portions forming a closed protective housing, and two lamellae serving as pole plates are enclosed therein together with the contacting parts so that adjustment of the relay is not possible after assembly. The parts are aligned in one shell-like housing portion before assembly. When the coil member is of a ceramic material, as proposed in the German Patent the required stability for retaining the pre-assembly adjustment is to some extent guaranteed. When, however, the coil member is made of a relatively thin-walled plastic in order to miniaturize the relay, then deformations of the coil member after assembly can be effected, particularly when applying the winding. It is, thus, not guaranteed that the pre-assembly adjustment setting and the functional reliability of the relay will be retained when the relay coil member is formed of plastic for miniaturization.

German Published Application No. OS 20 59 390 also discloses a multiple contact structure, wherein, for a two part base member, a plurality of pairs of pole plates are arranged in one plane in one housing part and are surrounded with glass frit. The same problem as set forth above would also arise in this case if the housing where fabricated of thin-walled plastic.

SUMMARY OF THE INVENTION

An object of the present invention is to provide a relay of few discrete parts in which a reliable operation is guaranteed by providing a stable position for the relay armature. Another object of the invention is to provide a relay which remains in a prescribed adjustment inside the coil member during assembly and in which there is also the possibility of adjusting the armature position or tension of the restoring spring after assembly, as needed.

These and other objects of the invention are inventively achieved by a relay including a restoring spring having the shape of a spring frame which extends in a longitudinal direction with an axial cavity in a coil member. The spring frame includes cross legs lying substantially parallel to a plane of the armature in the proximity of the restoring spring ends. The spring frame also includes long legs extending in planes lying perpendicular to the armature plane at both sides of the armature. A spring tongue is provided between the long legs of the spring frame and is connected to one of the cross legs. The spring tongue is substantially parallel to the armature plane and extends from the first cross leg up to proximate the second cross leg. A free end of the spring tongue is secured to the armature.

In the present invention, thus, the frame-shaped armature-restoring spring provides a relatively stable frame which retains the armature in a pre-assembly adjusted position with low tolerance. The frame is lent considerable stiffness by the long legs which are bent in perpendicular planes. Therefore, the almost certain deformation of the coil member does not lead to a significant maladjustment of the armature and of the pre-assembly tension of the restoring spring. Since the armature is, thus, oriented relative to the spring frame and is not fixed in a stop position in the coil member, there is also the possibility of undertaking a subsequent adjustment of the restoring force of the relay by acting on the armature or on the spring frame, such as in the region of a coil flange after assembly of the relay.

The coil member can be manufactured in one piece with the armature and the spring frame plugged into an opening, such as for example, through an end opening in the axial cavity. One pole piece, for example, can likewise be secured by plugging into the axial cavity proceeding from the opposite side. However, the coil member can also be composed of two parts connected to one another in an essentially axial plane. The two parts are formed in the shape of half shells that have a recess toward the inside in order to form the axial cavity when assembled. It is expedient in the such case to secure the spring frame by clamping between the two coil member halves.

In a first embodiment, the armature serves as a contact element. The armature has a first end seated at a fixed stop in the coil member in the proximity of the first cross leg of the spring frame, the armature is connected to the spring tongue in the proximity of its second moveable end, and has the second moveable end supported against the second cross leg of the spring frame. The fixed stop for the seated end of the armature, for example, is the terminating edge of a yoke section secured in a coil flange, whereby the yoke section acts as a type of knife-edge seat for the armature. The yoke section can be secured in a plug-in channel of an appertaining coil flange. This yoke section effects different spring tension of the spring frame depending upon its insertion depth in the plug-in channel. The yoke section is expediently provided with barbs to fix the appertaining yoke section in position in the coil member to maintain the spring tension setting after the spring tension adjustment which has been achieved.

Inside the coil member, the spring frame is supported by free edges of the long legs in a first radial direction, i.e., for example in a downward direction, and is supported by the cross legs in the opposite direction, i.e., for example, in an upward direction. Such support expediently is provided mainly in the region of the coil flanges of the coil member since the coil member experiences the least deformation there.

An especially favorable fastening of the spring frame and the armature occurs when the coil member is of two joined pieces and the spring frame has the cross legs clamped between rib-shaped projections on the two pieces of the coil member. In a special embodiment of the invention, the armature is secured to the spring tongue and has both ends moveable with both armature ends supported against the spring frame when in the quiescent position. In the working position, the two ends of the armature interact in contacting fashion with respective pole plates. A bridge contact relay that is especially suited for switching high voltages is obtained in this case.

An especially beneficial possibility for subsequent adjustment also derives with this embodiment. To this end, the spring tongue is extended beyond the first cross leg to form an adjustment tab and the first cross leg is reduced in cross section at both sides of the spring tongue to form torsion webs. The adjustment tab is adjustable in the region of the first coil flange through an adjustment element that can be modified from outside the relay. For example, the adjustment element can be a wall section of the axial cavity formed in the coil flange which is accessible from outside by an adjustment plunger or die. The wall section expediently comprises an inwardly directed nose-shaped projection for contact with the adjustment tab. In another embodiment, the adjustment element is a closing piece in the form of a ball or of a pin that is pressed into a wall opening above the adjustment tab.

DESCRIPTION OF THE PREFERRED EMBODIMENT

Figure 1:
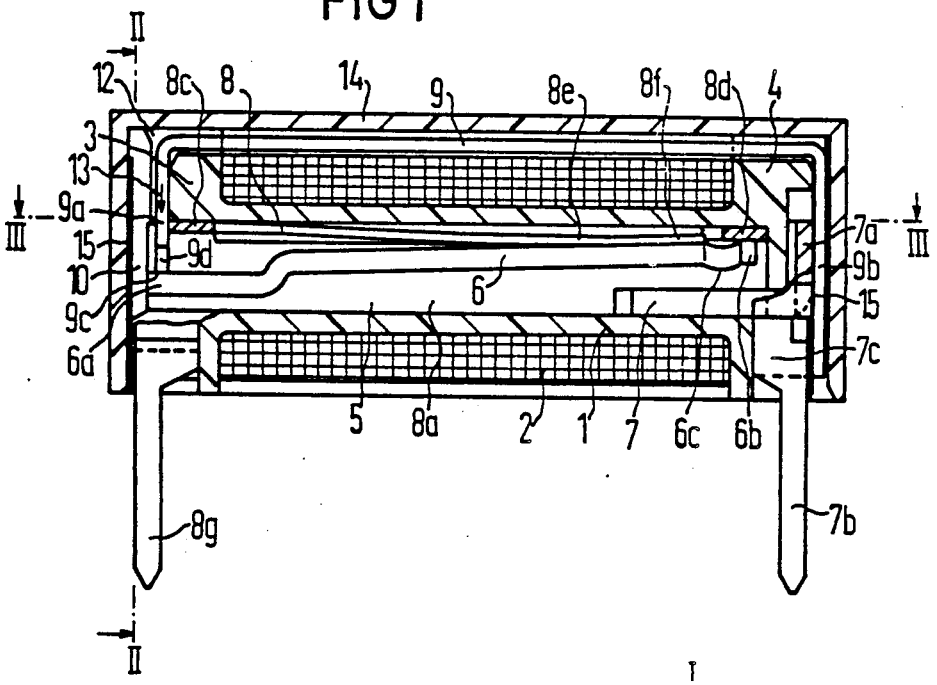
FIG. 1 is a cross section of a first embodiment of an inventive relay taken generally along line I—I of FIG. 2.
Figure 2:
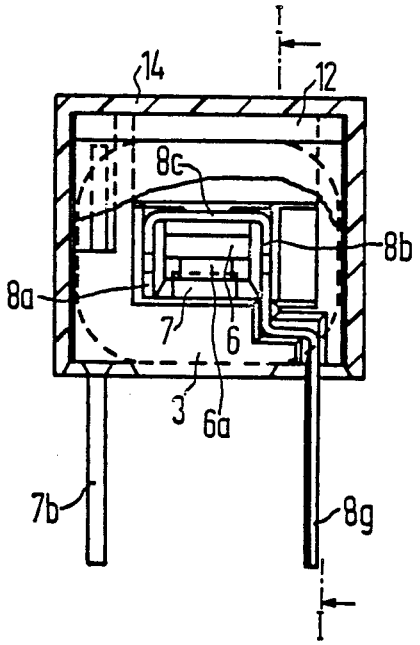
FIG. 2 is a cross section along line II—II of FIG. 1 of the first embodiment of the relay according to the present invention.
Figure 3:
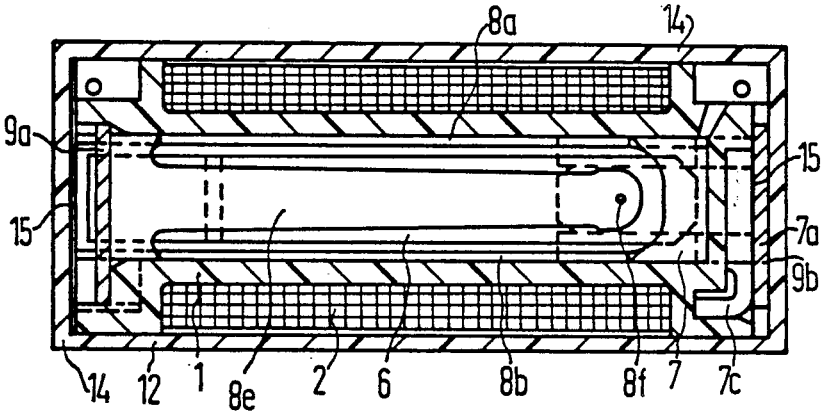
FIG. 3 is a cross section along line III—III of FIG. 1 of the present relay.

In FIGS. 1 through 3 are shown a first embodiment of a relay including a base body comprising a coil member 1 having a winding 2 applied between first and second flanges 3 and 4. The coil member 1 includes an axial cavity 5 for accepting an elongated, rigid armature 6 having a first end 6*a* seated in a region of the first coil flange 3 and a second end 6*b* forming a working air gap with a pole plate 7. During excitation of the relay, by application of electrical current to the winding 2, a web-shaped or calotte-shaped bellied portion 6*c* strikes the surface of the pole plate 7 and establishes contact therewith.

Figure 4:
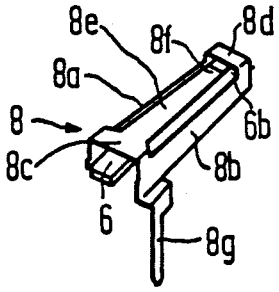
FIG. 4 is a perspective view of a spring frame and armature from the relay of FIG. 1.

The armature 6 is carried by a frame-shaped armature restoring spring in the shape of a spring frame 8, which is shown, for example, in perspective view in FIG. 4. The spring frame 8 in the illustrated example extends essentially over the entire length of the axial cavity 5. The spring frame 8 is composed of two long legs 8*a* and 8*b* lying perpendicularly relative to the plane of the armature 6. The spring frame 8 also includes two cross legs 8*c* and 8*d* that lie substantially parallel to the plane of the armature 6. As a result of the lateral angling of the long legs 8*a* and 8*b*, the spring frame 8 is lent adequate stability in order to hold the armature 6 in the prescribed position even given a certain deformation of the coil member 1. A spring tongue 8*e* that extends up to the proximity of the second cross leg 8*d* is connected to the first cross leg 8*c* between the two long legs 8*a* and 8*b*. At a free end 8*f*, the spring tongue 8*e* is connected to the armature such as by, for example, spot welding. The armature 6 is pre-stressed in an upward direction by the spring tongue 8*e*. The second end or free end 6*b* of the armature 6 is supported against the second cross leg 8*d*. A terminal pin 8*g* also extends from one of the long legs 8*b*.

In the present example, the seated end 6*a* of the armature 6 is applied to a section 9*a* of a U-shaped yoke 9 that is plugged over the coil member 1 from the outside. A second leg 9*b* of the U-shaped yoke 9 lies against the second coil flange 4 and is coupled to this coil flange in order to guarantee a good flux transition to a perpendicular leg 7*a* of the pole plate 7 to which, in addition, a terminal pin 7*b* is applied.

During assembly, the pole plate 7 is plugged into the coil member 1 from the right hand side with reference to FIG. 1. The armature 6 together with the spring frame 8 are plugged into the axial cavity 5 through an opening 10. The yoke 9 is thrust over the wound coil member 1 from above so that the leg 9*a* of the yoke is plugged into a plug-in channel 12 in the coil flange 3. The leg 9*a* thereby forms a knife-edge seat 9*c* for the armature end 6*a*. After the individual parts have been joined, the pre-assembly stress of the spring frame can be set to the correct value with the yoke leg 8*a* which serves as an adjustment tab in the present embodiment. To this end, the yoke leg 9*a* is pressed in the direction of arrow 13 until the desired value is achieved.

Figure 5:
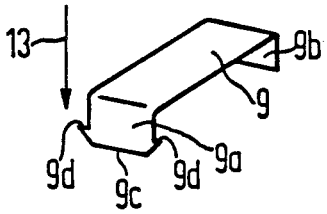
FIG. 5 is a perspective view of a yoke from the relay of FIG. 1.

As can be seen in FIG. 5, the yoke leg 9*a* has barbs 9*d* which dig into the material of the coil member 1 and fix the yoke leg 9*a* in place once the proper adjustment has been achieved. A cap 14 is then plugged over the relay with an insulating foil 15 in place between the cap 14 and the coil flange 3, as well as between the yoke leg 9*b* and the pole plate 7. The relay can be cast in the cap 14 as needed.

A further embodiment of the present invention as shown in FIG. 6 through 10 is particularly suited for automated production. This relay includes a coil member which is composed of first and second parts 20 and 21 formed as half-shell shaped parts toward the inside. These two parts 20 and 21 are provided with interengaging channels 20*a* and cooperating webs 21*a* so that an axial cavity is closed when the parts 20 and 21 are joined. A winding 22 is applied over the coil member between flanges 23 and 24. An armature 26 interacts with two pole plates 17 and 27 that, in the second embodiment, are embedded in or plugged into the lower coil member part 20. For contact with the pole plates 17 and 27, the armature has calottes 26*c* and 26*d* at each of the first and second ends 26*a* and 26*b*. The armature 26 is carried by a restoring spring in the form of a spring frame 28 that biases the armature in an upward direction so that the ends 26*a* and 26*b* are supported against the spring frame 28.

The spring frame 28 is formed similar to the spring frame 8 of the first embodiment. It includes long legs 28*a* and 28*b* as well as cross legs 28*c* and 28*d*. However, the cross leg 28*c* is reduced in cross section in regions adjacent the long legs 28*a* and 28*b* so that torsion webs 28*g* are formed. Moreover, a spring tongue 28*e* has a free end thereof connected to the armature 26 by a spot weld 28*f*. The spring tongue 28*e* also extends beyond the first cross leg 28*c* to form an adjustments tab 28*h*.

Figure 6:
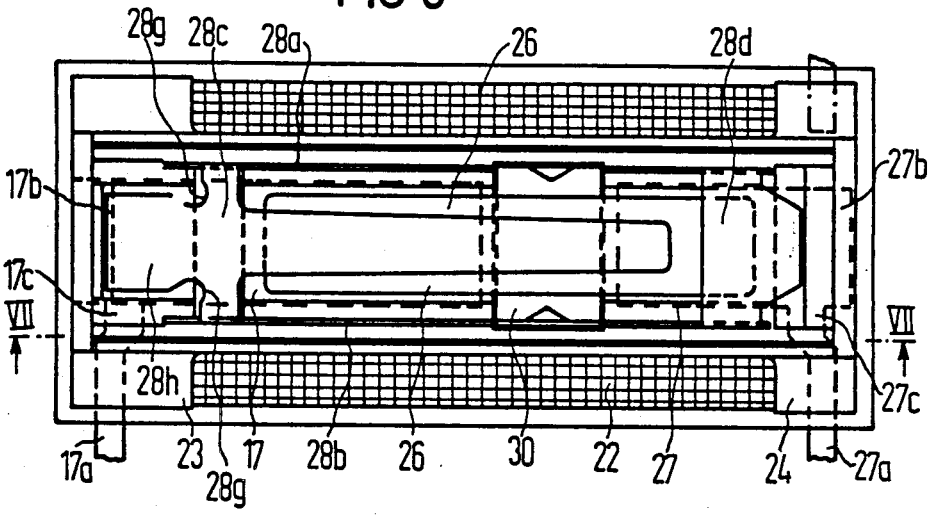
FIG. 6 is a cross section along VI–VI of FIG. 8 of a second embodiment of a relay in accordance with the principles of the present invention.
Figure 7:
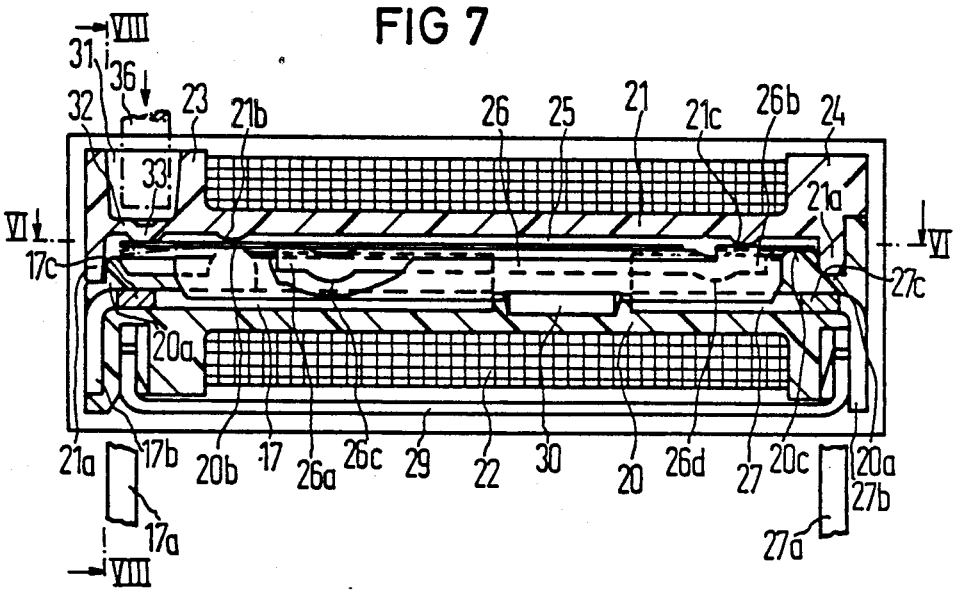
FIG. 7 is a cross section of the second embodiment of the relay taken generally along lines VII—VII of FIG. 6.
Figure 8:
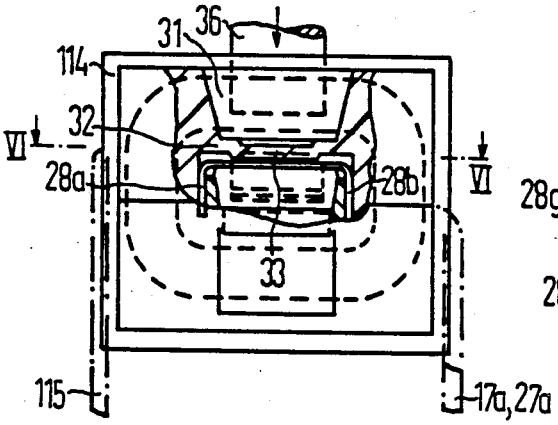
FIG. 8 is a cross section of the second relay embodiment taken along line VIII—VIII of FIG. 7.
Figure 9:
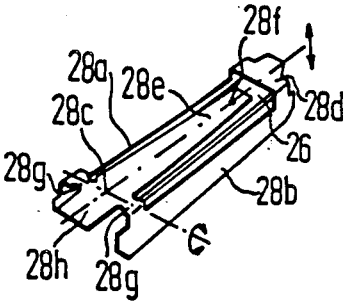
FIG. 9 is a perspective view of a spring frame from the relay of FIG. 6.

When the two coil member parts 20 and 21 are pressed together, the spring frame 28 is clamped between the two parts, and the cross legs 28*c* and 28*d* are each fixed between rib-shaped projections 20*b* and 20*c* and 21*b* and 21*c*, respectively. Provided with the two pole plates 17 and 27 that are bridged by the armature 26 and that are provided with terminal elements 17*a* and 27*a*, the relay of FIG. 6 through 8 is formed as a bridge contact relay. A yoke 29 closes the magnetic circuit between the two pole plates 17 and 27. Moreover, a getter body 30 of any suitable shape that is retained by the spring frame 28 is arranged in the contact space.

By influencing the adjustment tab 28*h* from outside the relay, the relay can be adjusted after assembly. To this end, the coil flange 23 includes a recess 31 having a relatively thin wall 32 toward the axial cavity. Further, the thin wall 32 has a projection 33 against which the adjustment tab 28*h* lies. The partition or thin wall 32 can be inwardly deformed with a coining die or plunger 36 so that the adjustment tab 28*h* is pressed down and the pre-assembly tension of the spring tongue 28*e* is increased.

Figure 10:
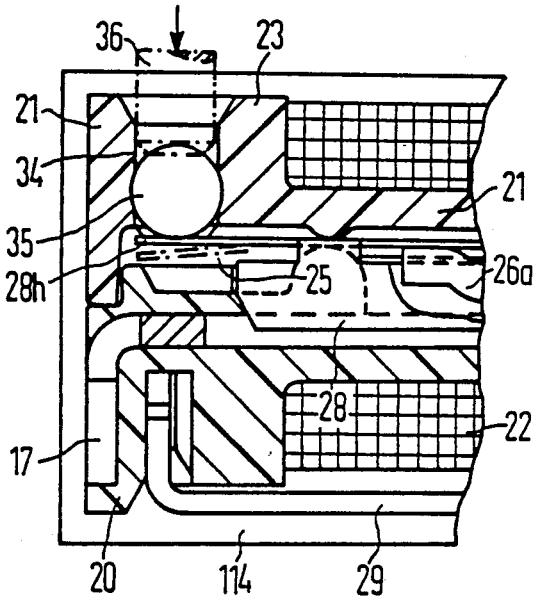
FIG. 10 is an enlarged cross section corresponding to a portion of FIG. 7 showing details of a spherical adjustment element.

Instead of deforming the partition 32, some other adjustment element can also be used. For example, in FIG. 10 is shown a portion of a relay similar to that of FIG. 7. In this case, however, the coil flange 23 has a through guide channel 34 opening into the axial cavity. A ball 35 of metal, glass or of some other relatively hard material has been pressed into the guide channel 34. The diameter of the ball 35 is somewhat greater than the diameter of the channel 34, so that the plastic material of the coil flange 23 is easily deformed and the ball 35 is retained in position after it has been pressed into the channel 34. The ball 35 presses on the adjustment tab 28*h* of the spring frame 28, so that the pre-assembly tension of the spring is adjusted by pressing the ball 35 into the channel 34 to a lesser or greater extent. At the same time, the ball 35 also closes the axial cavity 34 of the coil member to the outside. Instead of the ball 35, of course, a pin or some other differently shaped adjustment element can also be used.

The coil member formed by plugging the two parts 20 and 21 into one another can also be sealed to the outside with known measures such as the afore-mentioned casted cap.

Although other modifications and changes may be suggested by those skilled in the art, it is the intention of the inventor to embody within the patent warranted hereon all changes and modifications as reasonably and properly come with the scope of his contribution to the art.

With respect to FIGS. 1 to 3, it should be noted that the pole plate 7 is a generally flat plate disposed horizontally within the coil member 1 and parallel to the coil axis. At one end of the pole plate 7, adjacent to the second flange 4, the leg 7*a* is bent upwardly in a generally vertical direction. From one side of the leg 7*a*, a terminal leg 7*c* is bent so as to extend perpendicularly to both the plate 7 and the leg 7*a*. The terminal pin 7*b* extends downwardly from said terminal leg 7*c*.

In a similar way, in the embodiment of FIGS. 6 to 10, the pole plates 17 and 27 are generally flat and extend parallel to the coil axis. They have each a leg 17*b* and 27*b*, respectively, bent downwardly and extending in a vertical direction. The terminal pins 17*a* and 27*a* extend from the pole plates 17 and 27, respectively, at the sections 17*c* and 27*c*, and are bent downwardly to form the terminals 7*a* and 27*a* as indicated by broken lines in FIG. 8. When the relay is embedded in a casted covering 114 as indicated in FIG. 8, the terminals 17*a* and 27*a* may also be embedded partly. Coil terminal 115 may be bent to the opposite side in a similar way.

I claim:

1. An electromagnetic relay, comprising:

a winding;

a coil member carrying said winding and having two flanges and an axial cavity;

an elongated armature;

at least one pole plate projecting into said coil member and interacting with said armature;

said armature lying against said at least one pole plate in contacting fashion when said relay is excited;

a yoke arrangement situated essentially outside of said coil member and being a magnetic return; and a restoring spring secured in said coil member and connected to said elongated armature, said restoring spring biasing said armature to a quiescent position, said restoring spring having a spring frame shape extending into said coil member in a longitudinal direction of said axial cavity, said spring frame shape having cross legs lying substantially parallel to a plane of said armature in proximity to ends of said restoring spring, said spring frame including long legs extending in planes substantially perpendicular to said plane of said armature at both sides of said armature, said restoring spring including a spring tongue between said long legs of said spring frame, said spring tongue being connected to a first of said cross legs and extending substantially parallel to said plane of said armature up to proximate a second one of said cross legs, said spring tongue having a free end secured to said armature.

2. An electromagnetic relay as claimed in claim 1, wherein said coil member is of one piece, and said armature and said spring frame secured to said armature are plugged into a recess in said coil member in an axial direction, and said at least one pole plate is plugged into a recess in said coil member in an axial direction.

3. An electromagnetic relay as claimed in claim 1, wherein said coil member is composed of two parts connected together in a substantially axial plane, each of said two parts having an interior shell-like portion forming said axial cavity.

4. An electromagnetic relay as claimed in claim 1, wherein said armature has a first end seated on a fixed stop in said coil member proximate said first cross leg of said spring frame, said armature being connected to said spring tongue proximate a second movable end, and said second movable end of said armature being supported against said second cross leg of said spring frame.

5. An electromagnetic relay as claimed in claim 4, wherein said first end of said armature is seated on a first section of said yoke arrangement secured in a radial direction in a first of said two flanges.

6. An electromagnetic relay as claimed in claim 5, wherein said first section of said yoke arrangement is secured in a plug-in channel in said first of said two flanges, said first section of said yoke effecting tension of said spring frame depending upon depth of introduction in said plug-in channel.

7. An electromagnetic relay as claimed in claim 4, wherein said spring frame is supported inside said coil member with free edges of said long legs in a first radial direction and is supported in an opposite direction with said cross legs.

8. An electromagnetic relay as claimed in claim 7, wherein said cross legs support said spring frame in a region of said two flanges.

9. An electromagnetic relay as claimed in claim 3, further comprising:

rib-shaped projections of said two parts of said coil member clamping said cross legs of said spring frame.

10. An electromagnetic relay as claimed in claim 9, wherein said armature has both ends movable, said both ends of said armature being supported against said spring frame when in a quiescent position, and said both ends interacting with respective pole plates in contacting fashion when in a working position.

11. An electromagnetic relay as claimed in claim 9, wherein said spring tongue extends beyond said first cross leg to form an adjustment tab, said first cross leg has reduced cross section portions at both sides of said spring tongue to form torsion webs, and further comprising:

an adjustment element modifiable from outside of said relay to adjust said adjustment tab in a region of said first coil flange.

12. An electromagnetic relay as claimed in claim 11, wherein said adjustment element is a wall section of said axial cavity formed in said coil flange, said adjustment element being accessible from outside said relay by an adjustment die.

13. An electromagnetic relay as claimed in claim 12, wherein said wall section includes a nose-like projection extending toward said adjustment tab of said spring tongue.

14. An electromagnetic relay as claimed in claim 11, wherein said adjustment element is a closing piece pressed into a wall opening.

15. An electromagnetic relay as claimed in claim 14, wherein said closing piece is a ball.

16. An electromagnetic relay as claimed in claim 14, wherein said closing piece is a pin.

* * * * *